US006101815A

United States Patent [19]

van Oort et al.

[11] Patent Number: 6,101,815

[45] Date of Patent: Aug. 15, 2000

[54] THERMO-ELECTRICAL DEHUMIDIFIER

[75] Inventors: Johannes Martinus van Oort, Niskayuna; Paul Shadforth Thompson, Stephentown, both of N.Y.

[73] Assignee: General Electric Company, Schenectady, N.Y.

[21] Appl. No.: 09/225,765

[22] Filed: Jan. 5, 1999

Related U.S. Application Data

[63] Continuation of application No. 09/188,125, Nov. 9, 1998.

[51] Int. Cl.[7] ..... F25B 21/02; F25D 23/12

[52] U.S. Cl. ..... 62/3.4; 62/259.2

[58] Field of Search ..... 62/3.2, 3.3, 3.4, 62/271, 259.2

[56] References Cited

U.S. PATENT DOCUMENTS 3,126,710 3/1964 Boehmer et al. ..... 62/3.4
5,444,984 8/1995 Carson ..... 62/3.4
5,450,726 9/1995 Higgins ..... 62/3.4
5,884,486 3/1999 Hughes et al. ..... 62/3.4

FOREIGN PATENT DOCUMENTS 406117661 4/1994 Japan ..... 62/3.4

*Primary Examiner*—William Doerrler

[57] ABSTRACT

A dehumidifier for an x-ray detector includes a box having an inlet, an outlet, and a drain. A thermo-electrical element includes a cold plate disposed inside the box for cooling air channeled therethrough, and an opposite hot plate disposed outside the box for liberating heat. Air is cooled inside the box for condensing moisture therefrom which is removed by the drain, and the cooled air is heated for reducing relative humidity thereof. The resulting dry air is channeled to a housing protecting the x-ray detector.

20 Claims, 2 Drawing Sheets

THERMO-ELECTRICAL DEHUMIDIFIER

This application is a continuation of Ser. No. 09/188,125 filed Nov. 9, 1998.

BACKGROUND OF THE INVENTION

The present invention relates generally to x-ray detectors, and, more specifically, to a dehumidifier therefor.

A solid-state x-ray detector includes an array of amorphous silicon photodiodes and a cooperating scintillator. These components are subject to reduced life and reduced resolution upon absorbing moisture. Accordingly, these components are disposed in a housing for isolation from the ambient environment, including moisture therein, and the housing is filled with an inert gas such as nitrogen.

In this way, the operative components of the detector are kept dry from ambient water moisture, but the nitrogen environment thereof increases the complexity of the design, and increases life costs since the nitrogen is a consumable item.

Accordingly, it is desired to simplify this solid-state x-ray detector for eliminating the nitrogen environment therefor to reduce complexity and cost while maintaining long life and high resolution.

BRIEF SUMMARY OF THE INVENTION

A dehumidifier for an x-ray detector includes a box having an inlet, an outlet, and a drain. A thermo-electrical element includes a cold plate disposed inside the box for cooling air channeled therethrough, and an opposite hot plate disposed outside the box for liberating heat. Air is cooled inside the box for condensing moisture therefrom which is removed by the drain, and the cooled air is heated for reducing relative humidity thereof. The resulting dry air is channeled to a housing protecting the x-ray detector.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
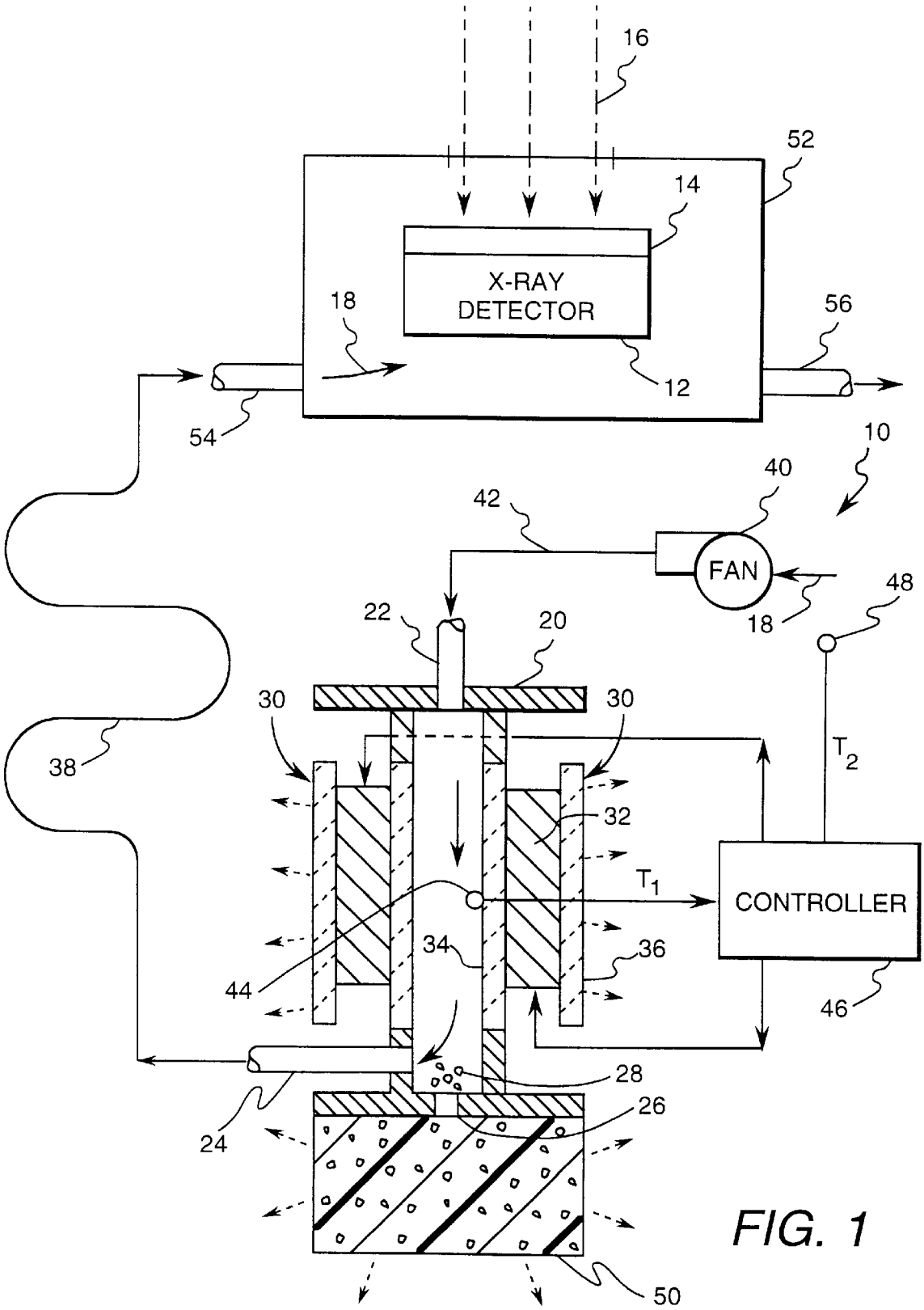
FIG. 1 is a schematic representation of a dehumidifier for an x-ray detector in accordance with an exemplary embodiment of the present invention.

Illustrated schematically in FIG. 1 is a substantially solid-state dehumidifier 10 for an x-ray detector 12 in accordance with an exemplary embodiment of the present invention. The x-ray detector 12 is conventional in configuration and includes an amorphous silicon grid of photodiodes which cooperate with a scintillator 14 disposed in a layer atop the detector.

During operation, x-rays 16 impinge the scintillator 14 which produces light beams which are detected by the detector 12 and are indicative of the original x-rays themselves. Since water moisture can substantially degrade the useful life of the detector and reduce the resolution of the scintillator, it is desired to provide a substantially moisture-free environment for these components with relatively low relative humidity.

More specifically, the dehumidifier 10 is specifically configured for dehumidifying ambient air 18 and substantially reducing its relative humidity for use in providing a dry environment for the x-ray detector 12 and its scintillator 14.

The dehumidifier 10 includes a substantially closed housing or cold box 20 having an inlet 22 for receiving the ambient air 18 at varying humidity including relatively high humidity. The cold box also includes an outlet 24 for discharging the air to the detector 12, and a drain 26 at its vertically lower end for draining any condensate 28 removed from the air.

Condensation of the moisture in the ambient air is effected using a solid-state thermo-electrical element 30, preferably disposed in an oppositely facing pair in the cold box 20. These elements are conventional and operate under the Peltier effect in which electrical current channeled therethrough simultaneously cools and heats different portions thereof.

More specifically, each element 30 includes a solid-state or semiconductor core 32 sandwiched between a cold plate 34 disposed inside the box 20 for cooling the air therein for discharge through the outlet 24, and an opposite hot plate 36 disposed outside the box for liberating heat. By passing an electrical current through the core 32, the cold plate 34 decreases in temperature whereas the hot plate 36 increases in temperature based on the Peltier effect. As the air 18 is channeled past the cold plate 34, its temperature is reduced for thusly condensing therefrom moisture which forms the condensate 28 that falls by gravity to the bottom of the cold box for discharge through the drain 26.

Conventional thermo-electrical elements are typically square in configuration, ranging from 12–75 mm square, and the ones used in the cold box are preferably 50 mm square. The two opposing cold plates 34 may be mounted flush in the walls of the box 20, with the box being correspondingly sized for reducing its volume and providing a sufficient flow channel between the cold plates for effecting condensation in the air channeled therethrough.

Although moisture is removed from the air inside the cold box 20, the remaining cold air has relatively high humidity at low temperature. Accordingly, means in the exemplary form of an elongate outlet conduit 38 are disposed in flow communication with the box outlet 24 for reheating the cooled air discharged therefrom for reducing the relative humidity thereof. The outlet conduit 38 extends from the box outlet 24 to the x-ray detector 12, and is exposed to the ambient environment and its temperature which is greater than the temperature of the cooled air inside the box 20. This is effective for heating the discharge air back to ambient or room temperature before reaching the x-ray detector. In this way, the outlet conduit 38 provides a passive heating means for raising the temperature of the discharge air.

In order to overcome pressure losses in the cold box 20 and the long outlet conduit 38, an air pump or fan 40 is operably joined to the cold box 20 for driving air therethrough to the detector. In the exemplary embodiment illustrated in FIG. 1, an inlet conduit 42 is disposed in flow communication between the box inlet 22 and the fan 40 for channeling the ambient air into the box and outwardly therefrom through the outlet conduit 38. The fan 40 is the only required moving component in the cold box and may have any conventional design for a suitable long life of at least about ten years for matching the life of the thermoelectric elements 30 and the solid-state x-ray detector 12.

Since the thermo-electric elements 30 have the capability to reach sub-freezing temperatures, the dehumidifier preferably also includes a first temperature sensor 44 disposed at or on the cold plate 34 for measuring the temperature $T_1$ thereof. A suitable controller 46, preferably in a simple, hardwired analog form, is operably joined to each of the thermoelectric elements 30 and the temperature sensor 44 for maintaining temperature of the cold plates preferably above the freezing temperature of water. The controller includes an associated power supply for providing sufficient electrical current to the solid-state cores 32 for effecting cooling therefrom.

A second temperature and relative humidity sensor 48 is preferably disposed upstream of the box inlet 22, for example just upstream of the fan 40, for measuring the temperature $T_2$ and relative humidity of the inlet air prior to being cooled in the box. The second sensor 48 is operably joined to the controller 46 (which also calculates the dew point temperature of the ambient inlet air from its temperature and relative humidity) for maintaining the temperature of the cold plates 34 below a dew point temperature of the ambient inlet air.

The controller and cooperating sensors 44,48 are preferably disposed in conventional closed feed-back loops with the cores 32 for controlling the temperature reduction of the inlet air. In this way, the inlet air may be cooled to an optimum temperature below the dew point temperature and above the freezing temperature, while at the same time maximizing efficiency of the thermoelectric elements 30. The inside of the cold box 20 thusly effects a refrigerator for the air channeled therethrough for condensing moisture therefrom which is collected and discharged through the drain 26.

In the exemplary embodiment illustrated in FIG. 1, an evaporator 50 in the exemplary form of a porous foam is disposed in flow communication with the drain 26 therebelow for absorbing and distributing the condensate 28. Ambient air is then effective for evaporating the condensate from the foam back into the atmosphere.

The air discharged from the cold box 20 is reheated to ambient temperature as it flows through the outlet conduit 38. The x-ray detector 12 and its scintillator 14 are preferably disposed in a remote housing 52 which provides an enclosed environment therefor, with the housing having a suitable window transparent to the x-rays 16 for transmission thereof. The outlet conduit 38 extends from the box outlet 24 to an inlet 54 of the remote housing 52 for channeling thereto the dehumidified discharge air. The remote housing 52 also includes an outlet 56 for discharging the dehumidified air from the housing 52 after passage therethrough.

The resulting combination of the dehumidifier 10 and x-ray detector 12 inside its housing 52 provides an improved combination of elements for maintaining a dry environment inside the housing 52 for ensuring long life of the x-ray detector 12 and maximum resolution of the scintillator 14 without compromise by air-borne water moisture. The resulting combination is substantially simpler and more cost effective than providing an inert gas, such as nitrogen, in continuous circulation around the x-ray detector.

Figure 2:
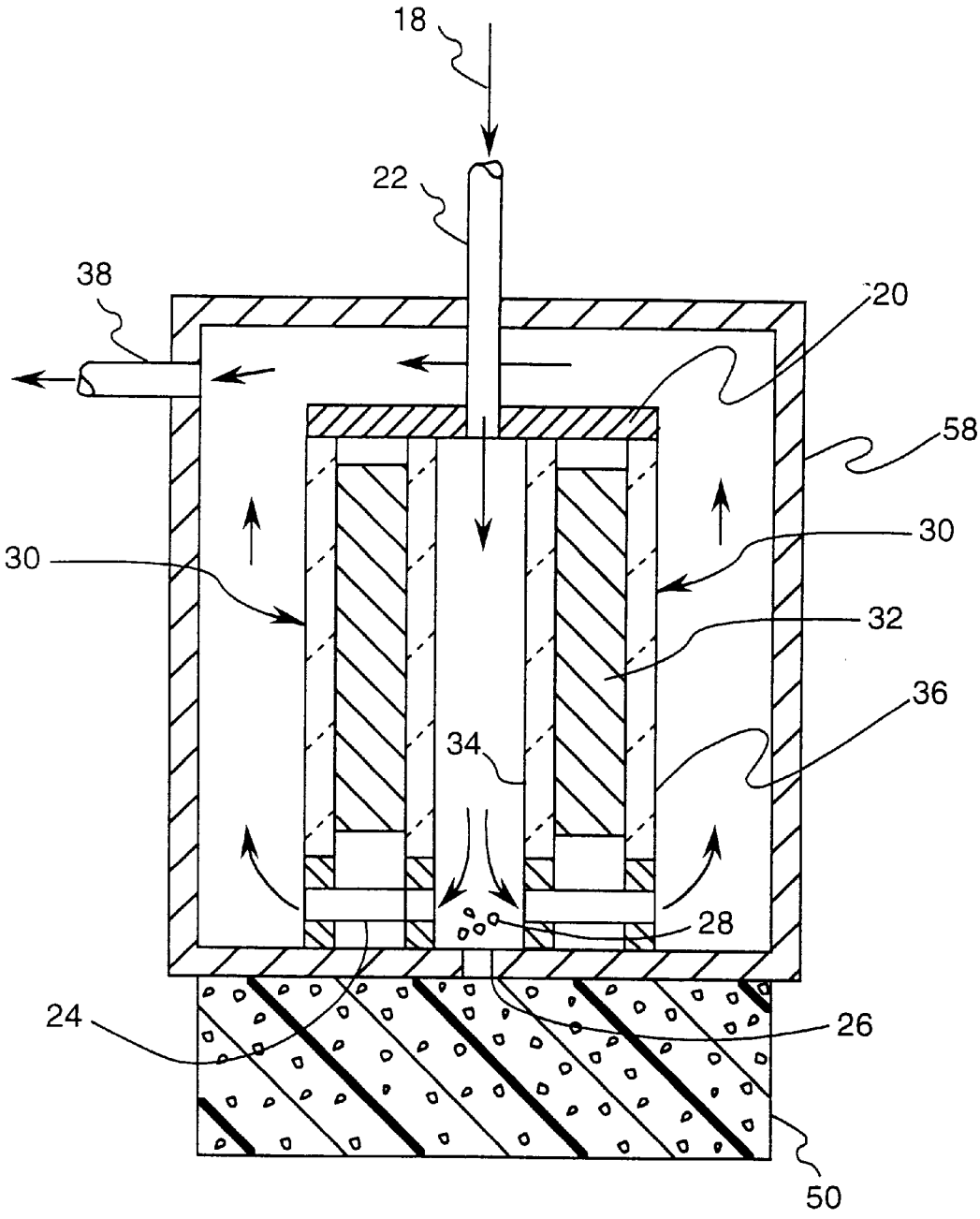
FIG. 2 is an elevational, partly sectional view of a cold box in the dehumidifier illustrated in FIG. 1 in accordance with an alternate embodiment of the present invention.

FIG. 2 illustrates an alternate embodiment of the cold box 20 for use in the system illustrated in FIG. 1 wherein the heating or reheating means for the cooled air 18 inside the cold box includes a closed plenum 58 configured for surrounding the cold box 20 and providing a flow passage therearound. In particular, the plenum 58 surrounds both hot plates 36 and is disposed in flow communication with a pair of the box outlets 24 for receiving the cold air from inside the box.

The outlets 24 are disposed at the bottom of the box for channeling the cold air upwardly along both hot plates 36 which actively heat the cold air for decreasing the relatively humidity thereof. The reheated air inside the plenum 58 is then channeled through the outlet conduit 38 to the remote housing 52. In this embodiment, the outlet conduit 38 may be relatively short, or the plenum may be directly joined in flow communication with the remote housing 52 for providing dehumidified air thereto.

Accordingly, the air 18 supplied to the remote housing 52 surrounding the x-ray detector may be accurately controlled in humidity, as well as temperature. The amount of initial cooling of the ambient air and any desired amount of reheating thereof may be controlled by the controller 46 for optimizing the environment inside the detector housing 52. Long life and high resolution of the detector are effected, along with a corresponding long life for the dehumidifier 10 itself.

While there have been described herein what are considered to be exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by letters patent of the united states is the invention as defined and differentiated in the following claims in which we claim:

1. A dehumidifier for an x-ray detector comprising:

a box having an inlet for receiving air, an outlet for discharging said air to said detector, and a drain;

a thermo-electrical element having a cold plate disposed inside said box for cooling said air for discharge through said outlet, and an opposite hot plate disposed outside said box for liberating heat; and means for heating said cooled air discharged through said outlet for reducing relatively humidity thereof.

2. A dehumidifier according to claim 1 further comprising:

a temperature sensor disposed at said cold plate for measuring temperature thereof; and a controller operably joined to said thermoelectrical element and said sensor for maintaining temperature of said cold plate above freezing.

3. A dehumidifier according to claim 2 further comprising a second temperature and relative humidity sensor disposed upstream of said box inlet for measuring the temperature and relative humidity of said inlet air prior to cooling in said box, and operably joined to said controller for maintaining the temperature of said cold plate below a dew point temperature of said inlet air.

4. A dehumidifier according to claim 3 further comprising a fan operably joined to said box for driving said air therethrough to said detector.

5. A dehumidifier according to claim 4 wherein said heating means comprise an elongate outlet conduit extending from said box outlet for delivering said discharge air to said detector, and exposed to ambient temperature for heating said discharge air.

6. A dehumidifier according to claim 4 wherein said heating means comprise a plenum surrounding said hot plate and disposed in flow communication with said box outlet for heating said discharge air received therefrom.

7. A dehumidifier according to claim 4 further comprising an evaporator disposed in flow communication with said drain for evaporating condensate received therefrom.

8. A dehumidifier according to claim 7 wherein said evaporator comprises a porous foam.

9. A dehumidifier according to claim 4 further comprising:

a remote housing for containing said x-ray detector;

an outlet conduit extending from said box outlet to said remote housing for channeling said discharge air thereto; and said housing having an outlet for discharging said air therefrom.

10. A dehumidifier according to claim 9 in combination with said x-ray detector mounted inside said remote housing.

11. A dehumidifier for an x-ray detector comprising:

a box having an inlet for receiving air, an outlet for discharging said air to said detector, and a drain;

a thermo-electrical element having cold plate disposed inside said box for cooling said air for discharge through said outlet, and an opposite hot plate disposed outside said box for liberating heat; and means for heating said cooled air discharged through said outlet for reducing relatively humidity thereof, and including an elongate outlet conduit extending from said box outlet for delivering said discharge air to said detector, and exposed to ambient temperature for heating said discharge air.

12. A dehumidifier according to claim 11 further comprising:

a remote housing containing said x-ray detector therein;

said outlet conduit extending from said box outlet to said remote housing for channeling said discharge air thereto; and said housing having an outlet for discharging said air therefrom.

13. A dehumidifier according to claim 12 further comprising:

a temperature sensor disposed at said cold plate for measuring temperature thereof; and a controller operably joined to said thermo-electrical element and said sensor for maintaining temperature of said cold plate above freezing.

14. A dehumidifier according to claim 13 further comprising a second temperature sensor disposed upstream of said box inlet for measuring temperature of said inlet air prior to cooling in said box, and operably joined to said controller for maintaining temperature of said cold plate below a dew point temperature of said inlet air.

15. A dehumidifier according to claim 14 further comprising a fan operably joined to said box for driving said air therethrough to said detector.

16. An x-ray detector dehumidifier comprising:

a remote housing containing an x-ray detector, and having an inlet and an outlet;

a box having an inlet for receiving air, an outlet disposed in flow communication with said housing inlet for discharging said air thereto, and a drain;

a thermo-electrical element having cold plate disposed inside said box for cooling said air for discharge through said box outlet, an opposite hot plate disposed outside said box for liberating heat, and a semiconductor core disposed therebetween; and means for heating said cooled air discharged from said box outlet for reducing relatively humidity thereof prior to flow into said housing inlet.

17. A dehumidifier according to claim 16 further comprising:

a temperature sensor disposed at said cold plate for measuring temperature thereof; and a controller operably joined to said thermo-electrical element and said sensor for maintaining temperature of said cold plate above freezing.

18. A dehumidifier according to claim 17 further comprising a second temperature sensor disposed upstream of said box inlet for measuring temperature of said inlet air prior to cooling in said box, and operably joined to said controller for maintaining temperature of said cold plate below a dew point temperature of said inlet air.

19. A dehumidifier according to claim 18 wherein said heating means comprise an elongate outlet conduit extending from said box outlet to said housing inlet for delivering said discharge air to said detector, and exposed to ambient temperature for heating said discharge air.

20. A dehumidifier according to claim 18 wherein said heating means comprise a plenum surrounding said hot plate and disposed in flow communication with said box outlet for heating said discharge air received therefrom, and further disposed in flow communication with said housing inlet for channeling said heated air thereto.

* * * * *